US007774937B2

(12) United States Patent
Agee

(10) Patent No.: US 7,774,937 B2
(45) Date of Patent: Aug. 17, 2010

(54) HEAT EXCHANGER WITH DIVIDED COOLANT CHAMBER

(75) Inventor: Keith Agee, Torrance, CA (US)

(73) Assignee: Honeywell International Inc., Morristown, NJ (US)

( * ) Notice: Subject to any disclaimer, the term of this patent is extended or adjusted under 35 U.S.C. 154(b) by 387 days.

(21) Appl. No.: 11/866,286

(22) Filed: Oct. 2, 2007

(65) Prior Publication Data

US 2009/0084532 A1 Apr. 2, 2009

(51) Int. Cl.
*B21D 53/02* (2006.01)
*F28F 9/22* (2006.01)

(52) U.S. Cl. ..... 29/890.03; 165/157; 165/159; 165/160

(58) Field of Classification Search ..... 165/158–161, 165/157; 29/890.03
See application file for complete search history.

(56) References Cited

U.S. PATENT DOCUMENTS 1,442,783 A * 1/1923 Braun ..... 165/161
2,058,324 A * 10/1936 Kuhner ..... 165/161
2,919,903 A * 1/1960 Vautrain et al. ..... 165/161
3,822,741 A * 7/1974 Lippitsch ..... 165/158
4,573,911 A * 3/1986 Kimmich ..... 165/161
6,334,484 B1 * 1/2002 Kandel ..... 165/158
6,595,274 B2 * 7/2003 Hayashi et al. ..... 165/158
7,077,190 B2 * 7/2006 Hayashi et al. ..... 165/159
2006/0048759 A1 * 3/2006 Hendrix et al. ..... 165/159

* cited by examiner

*Primary Examiner*—Leonard R Leo
(74) *Attorney, Agent, or Firm*—Chris James

(57) ABSTRACT

A heat exchanger has a shell and tube stack disposed within a shell inner chamber. A coolant chamber extends from a shell end, accommodates a portion of the tube stack, and has a sidewall that extends outwardly from the tube stack. A divider is disposed within the coolant chamber between the sidewall and tube stack, and extends axially along the chamber to the end of the shell splitting the coolant chamber into inlet and outlet coolant passages. For example, a pair of dividers are disposed within the coolant chamber and are attached to a respective sidewall surfaces. A coolant inlet and outlet is in fluid flow communication with respective inlet and outlet coolant passages. A cooling medium within the heat exchanger flows longitudinally within the inlet coolant passage along the tube stack in a direction opposite from the coolant flow path within the outlet coolant passage.

19 Claims, 4 Drawing Sheets

HEAT EXCHANGER WITH DIVIDED COOLANT CHAMBER

FIELD OF INVENTION

This invention relates generally to the field of heat exchangers and, more particularly, to shell and tube-type heat exchangers that are specially configured to provide improved coolant flow velocity therein to thereby reduce/eliminate the potential for unwanted coolant boiling within the heat exchanger and thus improve heat exchanger cooling efficiency and extend useful service life.

BACKGROUND OF THE INVENTION

The present invention relates to heat exchangers that are generally configured comprising a number of internal fluid or gas passages disposed within a surrounding body. In an example embodiment, the internal passages are designed to accommodate passage of a particular fluid or gas in need of cooling, and the body is configured to accommodate passage of a particular cooling fluid or gas used to reduce the temperature of the fluid or gas in the internal passages by heat transfer through the structure of the internal passages. A specific example of such a heat exchanger is one referred to as a shell and tube-type exchanger, which can be used in such applications as exhaust gas cooling for internal combustion engines.

Conventional shell and tube-type heat exchangers generally comprise a tube bundle made up of a plurality of individual tubes that are positioned within a surrounding shell. The shell is configured to both accommodate the tube bundle therein and to accommodate the passage of a cooling medium therein and along the tube bundle. Typically, the shell includes a coolant inlet and a coolant outlet to facilitate the passage of coolant therein, wherein the coolant inlet is positioned at one end of the shell, e.g., adjacent a hot-side inlet, and the coolant outlet is positioned at an opposite end of the shell, e.g., adjacent a hot side outlet.

A problem that is known to exist with such shell and tube-type heat exchangers is the unwanted boiling of the coolant within the exchanger during heat exchanger operation. For example, when such conventional heat exchangers are used to reduce the temperature of an incoming exhaust gas emitted from an internal combustion engine, e.g., when used in conjunction with an exhaust gas recirculation (EGR) system, a high heat flux can create an unwanted boiling of the coolant within the heat exchanger. Boiling of the coolant is undesired because it both reduces the cooling efficiency of heat exchanger, and because it produces a high-pressure condition within the heat exchanger that can damage and thereby reduce the heat exchanger service life.

Attempts that have been earlier made to reduce such unwanted boiling of the coolant has been to place baffles crosswise along an outside surface of the tubes to cause the coolant to pass within the heat exchanger along the tubes in a direction that was generally perpendicular to the otherwise flow path of the coolant, e.g., the use of the crosswise positioned baffles caused the coolant to flow in a serpentine flow path, thereby increasing the velocity of the coolant locally where the baffles induced a change of direction. This approach, however, both produced an unwanted pressure drop of the coolant moving through the heat exchanger, i.e., created an increased coolant pressure within the heat exchanger, and also created recirculation zones downstream of the baffles that resulted in unwanted coolant boiling just at a different location within the heat exchanger.

It is, therefore, desired that a heat exchanger be constructed in a manner that reduces and/or eliminates the potential for unwanted coolant boiling. It is further desired that such heat exchanger be constructed in a manner that does not otherwise impair the performance of the heat exchanger, e.g., that does not increase the pressure drop of the coolant moving through the heat exchanger.

SUMMARY OF THE INVENTION

Heat exchangers constructed in accordance with principles of the invention comprise a shell having an inner chamber defined by an inside wall surface. The shell can be formed from conventional materials used to form heat exchangers, e.g., metallic materials such as stainless steel or the like. A tube stack is disposed within the inner chamber and comprising a number of tubes that are arranged in a stack configuration. The tubes within the tube stack include first and second ends.

A coolant chamber is connected with an end of the shell and is configured to accommodate a portion of the tube stack therein. The coolant chamber comprises a sidewall that extends outwardly a distance from the tube stack. The coolant changer also includes a divider or baffle that extends inwardly within the coolant chamber from the sidewall to the tube stack, and that extending axially within the chamber to the end of the shell. The divider or baffle partitions the coolant chamber to form an inlet coolant passage and an outlet coolant passage therein.

In an example embodiment, the coolant chamber comprises a pair of opposed sidewalls that each extend outwardly a distance from the tube stack, and further comprises a pair of dividers or baffles that each extend between a respective sidewall and the tube stack. In an example embodiment, the divider or baffle is attached to the sidewall surface and extends inwardly towards a radial edge of a tube within the tube stack. The coolant chamber further includes a coolant inlet that is in fluid flow communication with the inlet coolant passage, and a coolant outlet that is in fluid flow communication with the outlet coolant passage. A cooling medium is disposed within the heat exchanger, and the cooling medium within the inlet coolant passage has a longitudinal flow path direction along the tube stack that is opposite from the coolant flow path direction within the outlet coolant passage.

Such heat exchangers can comprising a further coolant chamber, disposed at an end of the shell opposite from the initial coolant chamber, that is configured to accommodate a portion of the tube stack therein. Such other coolant chamber includes at least one sidewall that extends outwardly a distance from the tube stack and that defines a coolant flow path from the inlet coolant passage to the outlet coolant passage.

Such heat exchangers are made by assembling a number of tubes into a stacked arrangement to form the tube stack, and inserting the tube stack into the shell. The coolant chamber is disposed along one of the shell ends and accommodates a portion of the tube stack therein. The divider or baffle is positioned within the coolant chamber so that it extends inwardly a distance from the outwardly extending sidewall towards the tube stack, and extends longitudinally along the coolant chamber to a position adjacent the shell end. In an example embodiment, a pair of dividers or baffles are installed between opposed outwardly extending sidewalls of the cooling chamber a radial edge of a common tube within the tube stack to partition the cooling chamber to form the inlet and outlet coolant passages.

Heat exchanger be constructed in this manner, comprising the coolant path dividers or baffles, reduces and/or eliminates the potential for unwanted coolant boiling, and does so in a manner that greatly minimizes unwanted cooling medium pressure drop and the presence of dead zones within the heat exchanger that are otherwise associated with cross baffling. Additionally, by not extending the coolant flow path dividers or baffles axially beyond the coolant chamber, and making use of the close tolerances between the shell and tubes, heat exchangers of this invention are relatively easy to make while still providing adequate coolant velocity with minimal bypass.

BRIEF DESCRIPTION OF THE DRAWINGS

The invention will be more clearly understood with reference to the following drawings wherein.

DETAILED DESCRIPTION OF THE INVENTION

The present invention relates to heat exchangers used for reducing the temperature of an entering gas or fluid stream. A particular application for the heat exchangers of this invention is with vehicles and, more particularly, is to cool an exhaust gas stream from an internal combustion engine, e.g., as used with an EGR system. However, it will be readily understood by those skilled in the relevant technical field that the heat exchanger configurations of the present invention described herein can be used in a variety of different applications.

Generally, the invention constructed in accordance with the principles of this invention, comprises a heat exchanger including a stack of elongated, flattened tubes that are enclosed in a surrounding shell. The heat exchanger includes a coolant chamber at each end of the shell, wherein one of the coolant chambers is configured comprising a coolant inlet and coolant outlet, and further comprising one or more dividers or baffles disposed therein that operates to separate an inlet coolant passage from an outlet coolant outlet passage. Configured in this manner, the heat exchanger provides a two-pass coolant flow longitudinally therethrough having increased coolant velocity when compared to conventional one-pass heat exchangers and/or heat exchangers configured with crosswise baffles, thereby reducing and/or eliminating the occurrence of unwanted coolant boiling.

Figure 1:
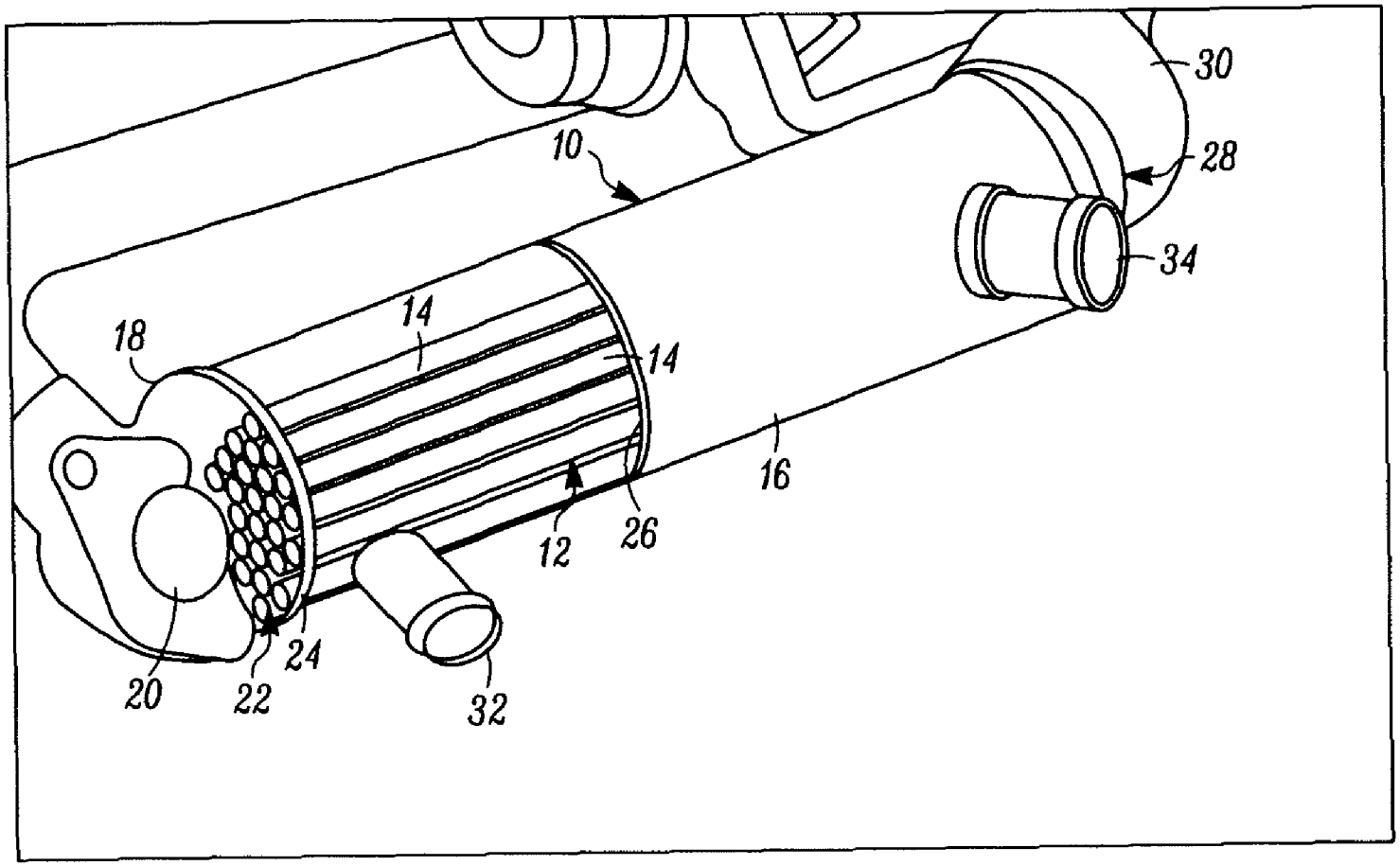
(PRIOR ART) FIG. 1
FIG. 1 is a perspective view of a prior art shell and tube heat exchanger.

FIG. 1 illustrates a conventional tube and shell-type heat exchanger 10 comprising a tube bundle 12 made up of a plurality of commonly oriented tubes 14. The tubes are disposed within a surrounding shell 16 that extends axially along the tubes. The shell 16 includes hot-side inlet manifold 18 extending from one of its ends and that includes a hot-side inlet 20. An inlet header plate 22 is disposed within the shell adjacent the hot-side inlet manifold 18 and comprises a number of openings 24 that are attached to ends of respective tubes 14. The inlet header plate 22 operates to both provide a desired separation between the tubes 14 and form a seal to prevent the passage of coolant from a coolant passage 26 into the hot-side manifold 18. The heat exchanger 10 includes a hot-side outlet manifold 28 that is attached to an opposite end of the shell 16 and that includes a hot-side outlet 30. An outlet header plate (not shown) similar to that already described is disposed at this other end of the shell.

The heat exchanger 10 comprises a coolant inlet 32 that is disposed adjacent the hot-side inlet manifold 18 and is positioned to introduce a desired coolant or cooling medium, e.g., a liquid cooling medium such as water, into the coolant passage 26 formed behind the inlet header plate 18 and that exists both between an inside surface of the shell and the tubes, and between the tubes themselves. A coolant outlet 34 is disposed at the opposite end of the shell adjacent the hot-side outlet manifold 28 and is positioned to facilitate the passage of the coolant from the heat exchanger.

Accordingly, in such conventional heat exchanger 10, a hot-side gas or fluid, enters the hot-side inlet manifold 18 and passes into and through the plurality of tubes 14, and exits via the hot-side outlet manifold 28. As the hot-side gas of fluid is passed through the heat exchanger, a coolant entering via the coolant inlet 32 is passed through the coolant passage and exits via the coolant outlet 34. The coolant passage 26 in such a conventional heat exchanger is of a one-pass configuration, i.e., the coolant passes only once over the tubes within the shell before exiting the heat exchanger. As briefly noted above, such heat exchangers are known to suffer from unwanted coolant boiling that reduces heat exchanger performance and can ultimately cause heat exchanger damage and/or failure.

Figure 2:
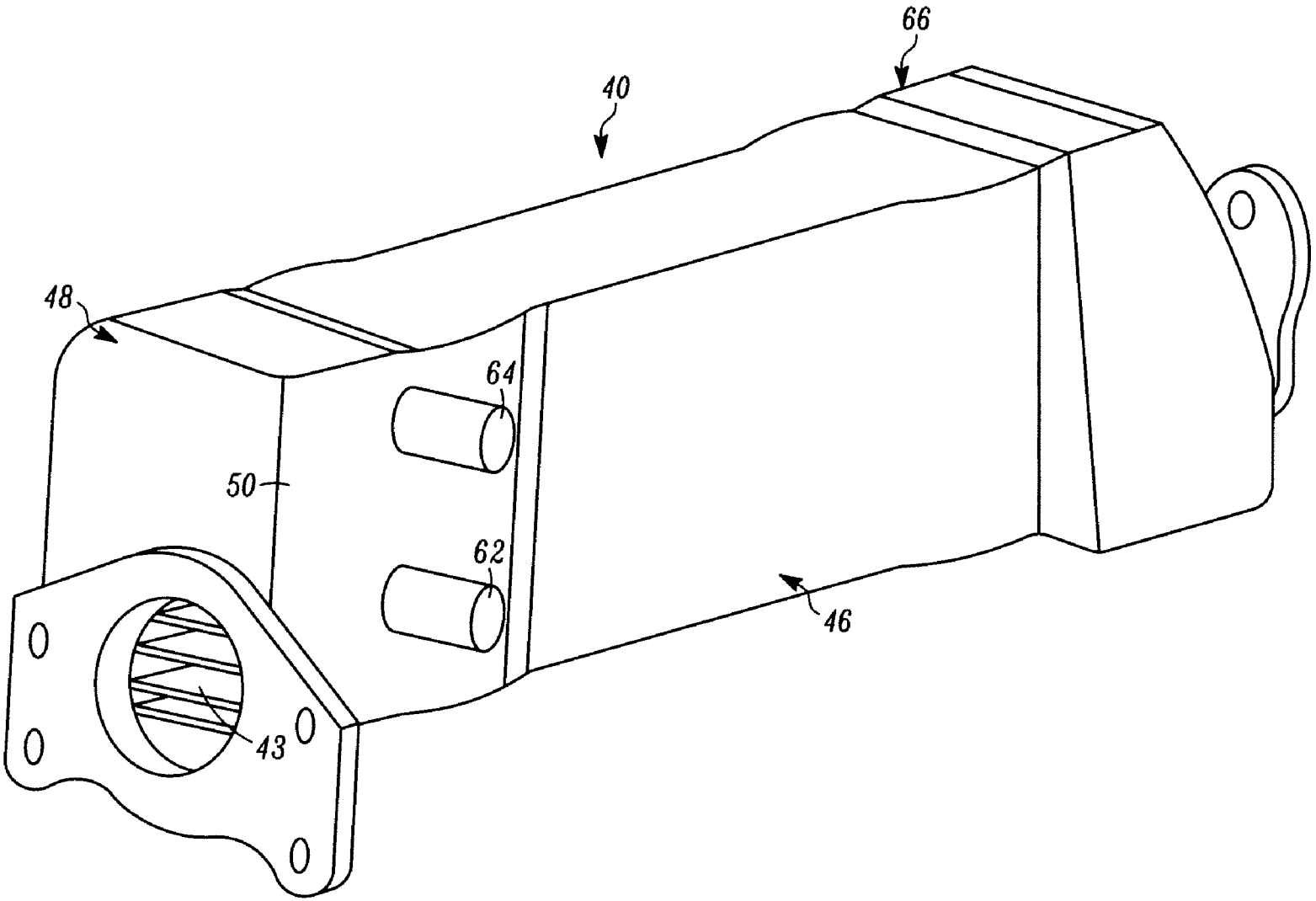
FIG. 2 is a perspective view of an example embodiment heat exchanger constructed according to principles of this invention.
Figure 3:
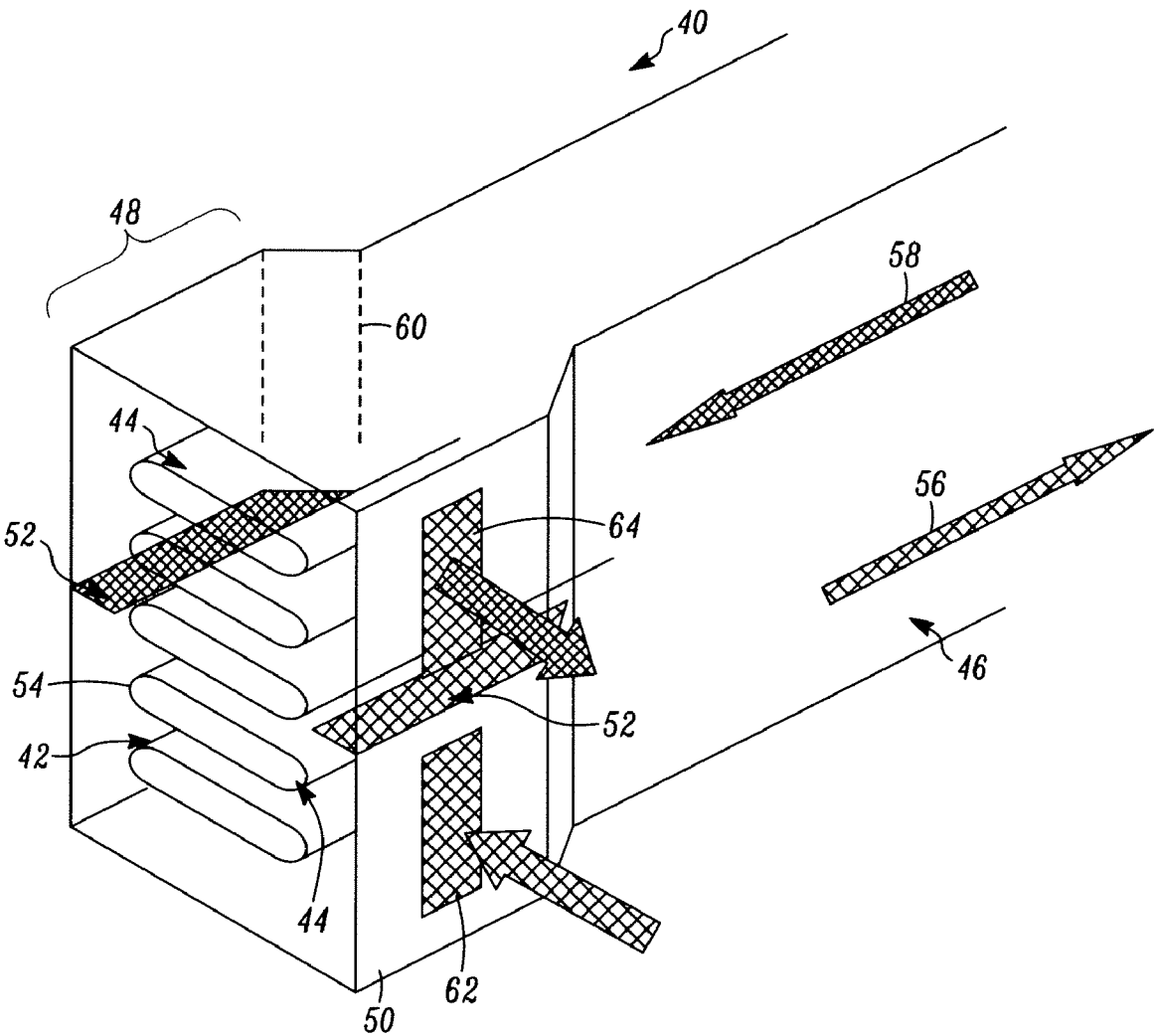
FIG. 3 is a perspective cut-away view taken from a section of the example embodiment heat exchanger of FIG. 2.
Figure 4:
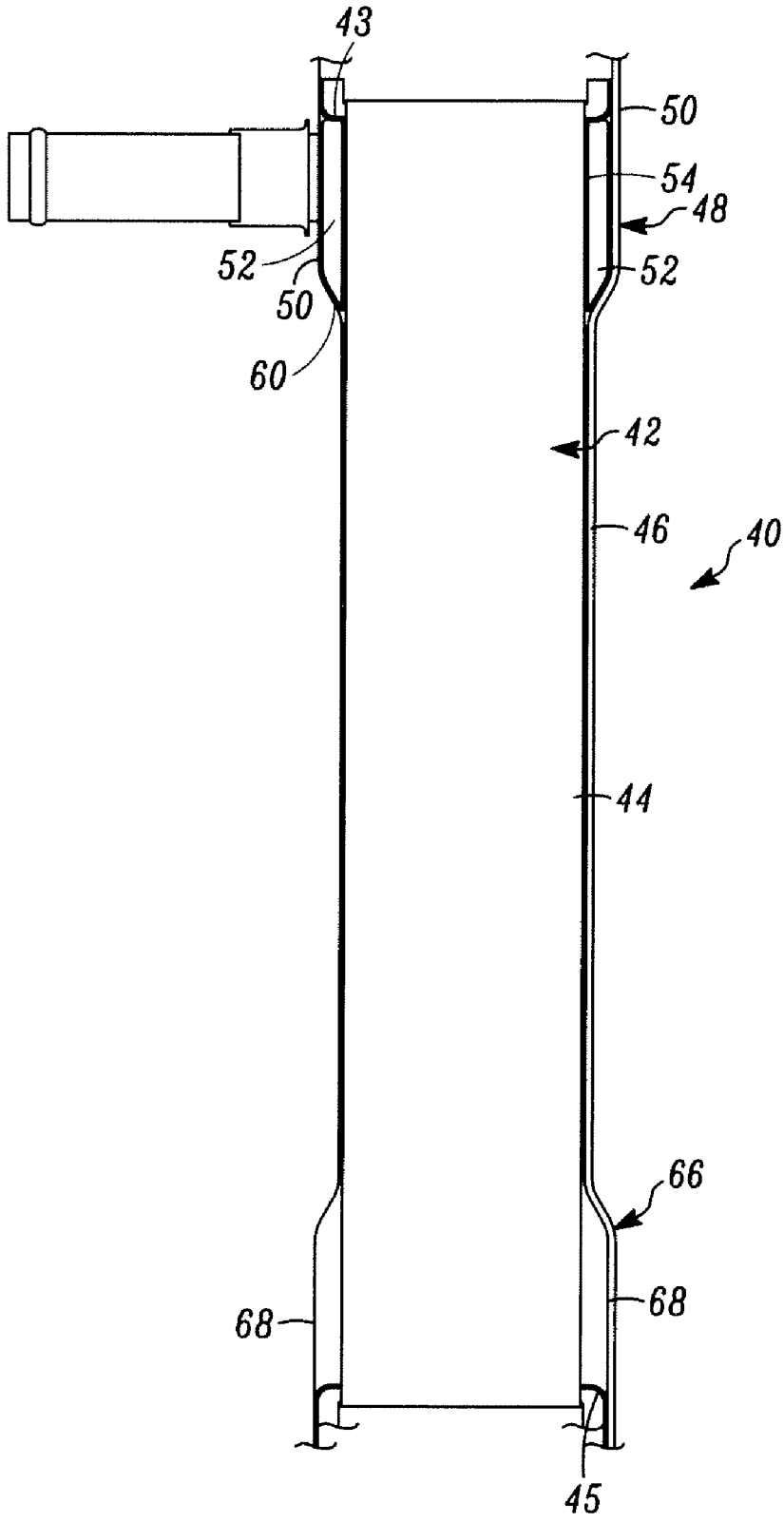
FIG. 4 is a top cross-sectional view of the heat exchanger of FIG. 3.

FIGS. 2 to 4 illustrate an example embodiment heat exchanger 40, constructed according to principles of this invention. The heat exchanger 40 includes a tube bundle 42 (best shown in FIG. 3), comprising a plurality of stacked tubes 44 (also shown in FIG. 3), that are attached adjacent the tube ends to inlet and outlet header plates 43 and 45 (shown in FIG. 4), and that are disposed within a surrounding shell 46. In an example embodiment, the tubes have a flattened configuration and are stacked one on top of another. Means are used to maintain a desired spacing between the stacked tubes. The heat exchanger 40 includes an inlet coolant chamber 48 that is configured having sidewalls 50 that project a distance outwardly from the shell 46 and from the tube stack 42. The coolant chamber 48 can be integral with the shell 46 or can be formed separately from the shell and attached thereto by conventional means, e.g., by brazing, welding or the like.

A feature of the coolant chamber 48 is that is it configured to accommodate the placement one or more coolant path dividers or baffles 52 therein. As best illustrated in FIGS. 3 and 4, in an example embodiment, a pair of baffles 52 are disposed within the coolant chamber 48 and each baffle is provided in the shape of a flat plate that is configured to extend inwardly from a respective sidewall 50 of the coolant chamber towards an opposed respective radial edge 54 of a common tube 44. In an example embodiment, each baffle 52 extends from a respective sidewall 50 and connects with a tube radial edge 54. In an example embodiment, the baffles 52 are positioned at a location vertically within the coolant chamber to split the chamber 48 into two coolant passages 56 and 58, and in a preferred embodiment to form two coolant passages of equal volume.

In an example embodiment, the baffles 52 are configured to extend axially/longitudinally from a position adjacent the inlet header plate 43 (at one baffle end) to the end of the coolant chamber (at an opposite baffle end), e.g., wherein the coolant chamber 48 meets with the shell end. Configured in this manner, the baffles 52 extend longitudinally along the heat exchanger 10 in a direction that is parallel to the main direction of the cooling medium that is flowing therein. In an example embodiment, the baffles extend along and are attached to the sidewall of the shell and are not attached to an adjacent header.

The baffles 52 can be attached to the coolant chamber sidewall 50 by conventional means, e.g., by welded or brazed attachment. The baffles can additionally be attached to the tube edge by the same means, or can simply be positioned adjacent the tube edge without a permanent attachment. In a preferred embodiment, the baffles are not permanently attached to the edges of the tube but are positioned to be in close tolerance therewith. In an example embodiment, the tolerance or clearance between the adjacent edges of the baffles and the tube radial edges is in the range of from about 0.25 to 1 mm, more preferably approximately 0.75 mm. It is to be understood that the exact amount of tolerance or clearance between the tube and baffle edges can and will vary, and ideally is the least amount possible while also taking into account such issues as the straightness of the tubes and shell.

Heat exchangers constructed in accordance with principles of this invention are configured having a desired tolerance or clearance between the radial edges of the stacked tubes and the inside surface of the shell that is sufficiently small so as to minimize the amount of coolant passage therebetween, and thus minimizing the bypass of coolant between the two coolant passages 56 and 58 running axially along the length of the tube stack within the shell. In an example embodiment, the tolerance between the radial edges of the tubes and the inside surface of the shell is in the range of from about 0.25 to 1 mm, more preferably approximately 0.75 mm. As noted above, such features as the straightness of the tubes and shell sidewall will have an impact on the amount of clearance or tolerance therebetween within the heat exchanger.

As best shown in FIG. 3, the baffles 52 operate to split the coolant chamber 48 into an inlet coolant passage 56 and an outlet coolant passage 58 that are each in fluid flow communication with a respective heat exchanger coolant inlet 62 and coolant outlet 64. Thus, a desired cooling medium entering the heat exchanger passes therein via the coolant inlet 62 and is directed over those tubes 44 disposed within the coolant chamber 48 that are partitioned by the dividers or baffles 52 and that thereby exist in the inlet coolant passage 56. The entering cooling medium passes first over this portion of tubes within the coolant chamber and is then directed axially or longitudinally along the length of such portion of the tube stack 42 towards a second cooling chamber 66 that is disposed at an end of the shell opposite from the coolant chamber 48.

As best shown in FIG. 4, the second coolant chamber 66 is configured similar to the coolant chamber 48 in that it includes one or more sidewalls 68 that project a distance outwardly from the tube edges to provide a desired distance therebetween than enables the cooling medium being passed along the tubes in the inlet coolant passage 56 to move radially around such tubes and to the tubes disposed within the outlet coolant passage 58. As this occurs, the flow of the cooling medium changes direction axially or longitudinally within the heat exchanger so that it is directed within the outlet coolant passage 58 back towards the coolant chamber 48, i.e., it reverses direction and thereby provides two-pass coolant flow through the heat exchanger.

As shown in FIG. 3, the cooling medium passing through the outlet coolant passage 58 passes axially or longitudinally along the surface of the tubes disposed therein that are partitioned by the baffles and enter the coolant chamber 48. The cooling medium entering the coolant chamber 48 from the outlet coolant passage 58 passes along those tubes disposed therein and exits the heat exchanger via the coolant outlet 64.

In a preferred embodiment, as illustrated in FIGS. 3 and 4, the heat exchanger is configured such that the coolant inlet 62 and the inlet coolant passage 56 are positioned along a bottom portion of the coolant chamber 48, and the coolant outlet 64 and the outlet coolant passage 64 are positioned along an upper portion of the coolant chamber 48. Additionally, the coolant inlet and coolant outlet are each positioned along the same coolant chamber sidewall.

Alternatively, heat exchangers of this invention can be constructed having the coolant passages and/or coolant inlets and/or outlets positioned differently than as disclosed and illustrated. For example, heat exchangers of this invention can be constructed having the coolant inlet and coolant outlet both positioned along the same sidewall surface of the cooling chamber, or can each be positioned at opposite coolant sidewall surfaces depending on the particular end-use application. Also, heat exchanges of this invention can be configured having the inlet coolant passage positioned above the outlet coolant passage again depending on the particular end-use application. Accordingly, heat exchangers comprising such cooling passage and/or cooling inlet/outlet placements are understood to be within the scope of this invention.

Additionally, while the heat exchanger embodiment described above and illustrated in FIGS. 3 and 4 is configured having a coolant chamber 48 comprising a pair of outwardly projecting sidewalls 50, and a pair of dividers or baffles 52 extending therefrom to an adjacent portion of a tube, heat exchangers of this invention can be also constructed having a differently configured cooling chamber to provide the desired separated or partitioned coolant passage flow paths. For example, the cooling chamber can be configured having only a single outwardly extending sidewall and a respective single divider or baffle extending therefrom to an adjacent tube end. In such alternative embodiment, the narrow tolerance or clearance between the tubes and the opposed coolant chamber sidewall surface operates to effectively form the desired separate or partitioned coolant flow paths, i.e., the inlet and outlet coolant passages. It is to be understood that this other embodiment of the heat exchanger is within the scope of this invention.

A feature of heat exchangers constructed in accordance with the principles of this invention is that they are specially configured to provide an improved degree of cooling performance when compared to other known heat exchanger designs such as those including cross baffles or the like, i.e., having baffles arranged therein perpendicular to the main direction of coolant flow. Heat exchangers of this invention comprise one or more coolant path dividers or baffles that are disposed within the coolant chamber and that extend axially or longitudinally and generally parallel to the main direction of coolant flow within the heat exchanger.

The use of such coolant path dividers greatly minimizes unwanted cooling medium pressure drop and the presence of dead zones within the heat exchanger that are otherwise associated with cross baffling. Additionally, by not extending the coolant flow path dividers or baffles axially beyond the coolant chamber, and making use of the close tolerances between the shell and tubes, heat exchangers of this invention are relatively easy to make while still providing adequate coolant velocity with minimal bypass.

While heat exchanges of this invention have been described as being useful in such applications as EGR systems and turbocharger systems used in conjunction with internal combustion engines. It is to be understood that heat exchangers of this invention can be used in a number of other use applications where unwanted boiling of the cooling medium is known to or may occur, that reduces heat exchanger cooling efficiency and/or that can lead to heat exchanger damage and reduced service life. Accordingly, heat exchangers of this invention provide improved heat exchanger cooling performance and improved heat exchanger service life when compared to those conventional heat exchangers described above.

It is to be understood that the heat exchanger embodiments described above and illustrated are but examples of heat exchangers as constructed according to principles of this invention, and that those skilled in the art will recognize modifications and substitutions to the specific embodiments disclosed herein. Such modifications are within the scope and intent of the present invention.

What is claimed is:

1. A heat exchanger comprising:

a shell having a first end and a second end;

coolant chambers attached to the ends of the shell;

the shell having an inner chamber defined by an inside wall surface;

a tube stack disposed within the inner chamber and comprising a number of tubes arranged in a stack, the tubes including first and second ends;

the tube stack extending beyond the ends of the shell and extending into the coolant chambers;

the coolant chamber having a cross-sectional area greater than a cross-sectional area of the inner chamber and the coolant chamber comprising:

a sidewall extending outwardly a distance from the tube stack;

at least one divider extending into only a first one the coolant chambers from the sidewall of the coolant chamber toward a flattened one of the tubes and extending axially from a first end of the shell to an end of the coolant chamber that is distal from the shell;

wherein the divider and the flattened one of the tubes form a partition through the coolant chamber;

wherein a first portion of an inlet coolant passage is formed on one side of the partition and a first portion of an outlet coolant passage is formed on an opposite side of the partition;

wherein a portion of the flattened tube extends axially from the coolant chamber to a second end of the shell to form a partition through the shell to form a second portion of the inlet coolant passage and a second portion of the outlet coolant passage;

wherein the divider does not extend into the shell or the second one of the coolant chambers; and wherein a coolant inlet is in fluid flow communication with the inlet coolant passage, and a coolant outlet is in fluid flow communication with the outlet coolant passage.

2. The heat exchanger as recited in claim 1 wherein the first coolant chamber comprises a pair of opposed sidewalls that each extend outwardly a distance from the tube stack, and further comprises a pair of the dividers that each extend between a respective sidewall and the flattened tube.

3. The heat exchanger as recited in claim 1 wherein the divider is attached to the sidewall surface and extends towards a radial edge of the flattened tube within the tube stack.

4. The heat exchanger as recited in claim 3 wherein a clearance exists between the divider and the radial edge.

5. The heat exchanger as recited in claim 4 wherein the clearance is in the range of from about 0.25 to 1 mm.

6. The heat exchanger as recited in claim 1 the second coolant chamber is disposed at the second end of the shell and accommodates a portion of the tube stack therein, wherein the further coolant chamber includes at least one sidewall that extends outwardly a distance from the tube stack and that defines a coolant flow path from the inlet coolant passage to the outlet coolant passage.

7. The heat exchanger as recited in claim 1 wherein a clearance exists between radial edges of the flattened tube in the tube stack disposed within the shell and an adjacent shell inside wall surface of from about 0.25 to 1 mm.

8. The heat exchanger as recited in claim 1 further comprising a cooling medium disposed therein, wherein the cooling medium within the inlet coolant passage has a longitudinal flow path direction along the tube stack that is opposite from the coolant flow path direction within the outlet coolant passage.

9. A heat exchanger comprising:

a shell for enclosing a flow of coolant, the shell having an inner chamber defined by an inside wall surface and first and second opposed shell ends;

a tube stack for enclosing a hot gas stream, the tube stack disposed within the inner chamber and comprising a number of tubes arranged on top of one another, the tubes including first and second ends;

at least one tube of the tube stack being flattened and having radial edges proximate to the inside wall surface with clearance between the radial edges and the inside wall surface such that coolant bypass between the at least one tube and the inside wall surface is minimized;

a first coolant chamber connected with one end of the shell, the coolant chamber accommodating a portion of the tube stack therein adjacent the tube first ends, the first coolant chamber comprising:

a sidewall extending outwardly a distance from radial edges of the tubes within the tube stack that exceeds the clearance between the radial edges of the at least one tube and an adjacent inside wall surface of the shell inner chamber;

a divider extending inwardly from the first coolant chamber sidewall to the at least one flattened tube of the tube stack and extending axially only to the first end of the shell, wherein the divider, in combination with a portion of the at least one tube, forms an inlet coolant passage and an outlet coolant passage within the first coolant chamber; and a coolant inlet in fluid-flow communication with the inlet coolant passage, and a coolant outlet in fluid-flow communication with the outlet coolant passage;

a second coolant chamber connected with the second end of the shell opposite the first coolant chamber, the second coolant chamber accommodating a portion of the tube stack therein adjacent the tube second ends and comprising a sidewall that extends outwardly a distance from radial edges of the at least one tube that exceeds a clearance between the radial edges and an adjacent inside wall surface of the shell inner chamber, wherein the second coolant chamber outwardly extending sidewall surface defines a coolant flow path between the inlet coolant passage and the outlet coolant passage.

10. The heat exchanger as recited in claim 9 wherein the first cooling chamber comprises a pair of outwardly extending opposed sidewalls, and a pair of dividers are disposed within the first cooling chamber and each extend between the respective outwardly extending sidewalls and radial edges of the least the at one flattened tube with the tube stack.

11. The heat exchanger as recited in claim 10 wherein each divider is attached to the respective first coolant chamber sidewall.

12. The heat exchanger as recited in claim 10 wherein a clearance of from about 0.25 to 1 mm exists between each divider and an adjacent surface of a respective tube radial edge.

13. The heat exchanger as recited in claim 9 wherein the first coolant chamber has an angled transition wall surface between the outwardly extending sidewall and the shell end.

14. The heat exchanger as recited in claim 9 further comprising a cooling medium, and wherein the cooling medium within the inlet coolant passage flows in a longitudinal direction through the tube stack that is opposite to the flow path of the cooling medium within the outlet coolant passage.

15. The heat exchanger as recited in claim 9 further comprising header plates positioned at opposite ends of the tube stack, wherein each header plate is attached to respective tube first and second ends and the heat exchanger.

16. The heat exchanger as recited in claim 15 wherein the divider is not attached to a header plate.

17. A method for making a heat exchanger comprising the steps of:

assembling a number of tubes into a stacked arrangement to form a tube stack;

inserting the tube stack with at least one flattened tube into a shell, the shell having a surrounding inner chamber extending between first and second opposed shell ends, wherein the flattened tube partitions the shell into a first fluid flow passage and a second fluid flow passage;

attaching a coolant chamber adjacent the first one of the shell ends to accommodate a portion of the tube stack therein, the coolant chamber comprising a sidewall that extends outwardly a distance from the flattened tube of the tube stack; and placing a divider within the coolant chamber that extends inwardly from the outwardly extending sidewall to a position that is about 0.25 to about 1 mm from radial edges of at least one flattened tube of the tube stack, the divider extending longitudinally along the coolant chamber only to a position adjacent the first shell end so that the divider, in combination with the at least one tube forms an inlet coolant passage and an outlet coolant passage within the heat exchanger, and wherein the coolant chamber includes a coolant inlet and a coolant outlet.

18. The method as recited in claim 17 wherein the coolant chamber includes a pair of opposed sidewalls that extend outwardly a distance from the tube stack, and wherein during the step of placing, placing a pair of dividers within the coolant chamber, wherein each divider is attached to a respective sidewall and a radial edge of the at least one flattened tube tube within the tube stack.

19. The method as recited in claim 17 wherein the heat exchanger includes a further coolant chamber that is attached to the second end of the shell, and wherein the further coolant chamber includes a sidewall surface that extends outwardly a distance from the tube stack to provide a coolant flow path between the inlet coolant passage and the outlet coolant passage, and wherein coolant within the inlet coolant passage flows in a direction that is opposite to the direction of coolant flow within the outlet coolant passage.

* * * * *